US012134910B1

(12) United States Patent
Gould

(10) Patent No.: US 12,134,910 B1
(45) Date of Patent: Nov. 5, 2024

(54) DEVICE AND FENCING SYSTEM FOR CANINE CONTAINMENT

(71) Applicant: BITE ME ENTERPRISES, INC., Port Jefferson Station, NY (US)

(72) Inventor: Michael S Gould, Setauket, NY (US)

(73) Assignee: BITE ME ENTERPRISES, INC., Port Jefferson, NY (US)

( * ) Notice: Subject to any disclaimer, the term of this patent is extended or adjusted under 35 U.S.C. 154(b) by 412 days.

(21) Appl. No.: 17/826,778

(22) Filed: May 27, 2022

Related U.S. Application Data

(60) Provisional application No. 63/194,594, filed on May 28, 2021.

(51) Int. Cl.
*E04H 17/00* (2006.01)

(52) U.S. Cl.
CPC ..... *E04H 17/004* (2021.01)

(58) Field of Classification Search
CPC ..... E04H 17/003; E04H 17/004
See application file for complete search history.

(56) References Cited

U.S. PATENT DOCUMENTS 321,171 A * 6/1885 Archibald ..... E04H 17/004 256/12
511,700 A * 12/1893 Jacobs ..... E04H 17/004 256/12
4,270,736 A * 6/1981 Burch ..... E04H 17/24 256/16
4,348,012 A * 9/1982 McLoughlin ..... E04H 17/004 256/16
5,143,354 A * 9/1992 Nolan ..... E04H 17/003 256/11
6,102,375 A * 8/2000 Colless ..... E01F 15/086 256/26
6,585,233 B1 * 7/2003 Sorben ..... E04H 17/00 256/1
8,162,292 B2 4/2012 Farmer
8,240,094 B1 * 8/2012 Serschen ..... A01M 29/32 248/231.71
D751,729 S 3/2016 Le Clair
9,924,707 B2 * 3/2018 Dambra ..... E04D 13/004
10,472,884 B2 * 11/2019 Maytorena ..... E04H 17/004
11,028,614 B1 * 6/2021 Robinson ..... A01M 29/06
(Continued)

*Primary Examiner* — Daniel J Wiley
(74) *Attorney, Agent, or Firm* — BKDowd Law, P.C.; Betsy Kingsbury Dowd, Esq

(57) ABSTRACT

A device for canine containment includes a pair of opposing brackets, each including a mounting portion and support plate, and two pins extending perpendicularly therefrom aligned in a vertical plane. The device includes two hollow cylindrical rods configured to hang from and roll freely around each set of upper pins and lower pins extending from opposing brackets. The pair of opposing brackets with the two hollow cylindrical rods mounted therebetween form a unit configured to place atop a fence panel intact and fixed thereto. A method of installing the device includes adjusting a length of the rods based on a distance between adjacent fence posts; mounting ends of upper/lower cylindrical rod, over upper/lower pins; pushing opposing brackets toward each other, and mounting the device intact onto the fence panel via the mounting portions; and sliding each of the opposing brackets outward until each rests flush against the adjacent post.

16 Claims, 10 Drawing Sheets

(56) References Cited

U.S. PATENT DOCUMENTS

2003/0015301 A1* 1/2003 Killo ..... E06B 9/50
160/310
2010/0229802 A1* 9/2010 Bok ..... E04H 17/004
119/416

* cited by examiner

DEVICE AND FENCING SYSTEM FOR CANINE CONTAINMENT

CROSS-REFERENCE TO RELATED APPLICATIONS

This application claims the benefit of and priority to U.S. Provisional Application Ser. No. 63/194,594 entitled "DEVICE AND FENCING SYSTEM FOR CANINE CONTAINMENT," filed May 28, 2021, the entirety of which is hereby incorporated herein by reference thereto.

FIELD OF THE DISCLOSURE

The present invention relates to fencing to contain an animal within a designated fenced area, and also to prevent animals from entering the designated fenced area, in particular, to fencing with attachments that prevent an animal, particularly dogs, from scaling over the fencing to enter or exit a designated fenced area.

BACKGROUND

Various attempts have been made in the prior art to add structures to an upper side of a fence that create areas of instability in order to prevent a dog, for example, from climbing the fence and escaping over it. Some of these prior art systems require special made fencing to accommodate the added structure. Other fencing attachment systems for canine containment consist of complicated assemblies which require customized hardware, tools, to attach to the posts, or other parts of the particular fence being modified. Both systems are labor-intensive installations.

Furthermore, none of the known systems can successfully prevent the more agile dog breeds from scaling a fence when attached to a fence of standard height of four (4) or five (5) feet.

Accordingly, there is a still a need for a device for attaching to any standard fence that inhibits animals from scaling over the fence, and that requires no tools or complicated mounting hardware to install. There is also a need for a fencing system including the device configured for installation on a commercial fence.

SUMMARY

Features of the disclosure will become apparent from the following detailed description considered in conjunction with the accompanying drawings. It is to be understood, however, that the drawings are designed as an illustration only and not as a representation of the limits of this disclosure.

The present disclosure relates to a system and device configured for attaching to a commercial fence that inhibits animals from scaling over the fence. The device may be configured to attach to any standard fence, and requires no tools or complicated mounting hardware to install.

The present disclosure also relates to a fencing system that includes a commercial fence and any of the embodiments of the device of the present disclosure configured for installation on the commercial fence.

The present disclosure also relates to a device configured for installation on a fence panel of a fence for canine containment. The device includes a pair of opposing brackets, each opposing bracket including a mounting portion configured for mounting on a fence panel and a support plate extending upward from the mounting portion. Two pins extend perpendicularly from the support plate of each opposing bracket, that is, an upper pin and a lower pin, which are preferably aligned in a vertical plane. The device also includes two hollow cylindrical rods mounted between the pair of opposing brackets. Each end of an upper one of the two hollow cylindrical rods is rotatably mounted onto the upper pin of each opposing bracket, and each end of a lower one of the two hollow cylindrical rods is rotatably mounted onto the lower pin of each opposing bracket. The pair of opposing brackets with the two hollow cylindrical rods mounted therebetween form a unit configured to place atop a fence panel intact and fixed thereto.

In embodiments, the device also includes a fastening element mounted through a vertical wall of the mounting portion, configured to secure the device in position on the fence panel.

In one embodiment, the fastening element is configured to tighten the device against the fence panel.

The present disclosure is also directed to a device configured for installation on a fence panel of a fence for canine containment, which includes a pair of opposing brackets, each opposing bracket including a mounting portion configured for mounting on a fence panel and a support plate extending upward from the mounting portion. Two pins extend perpendicularly from the support plate of each opposing bracket, the two pins including an upper pin and a lower pin aligned in a vertical plane.

In embodiments, the hollow cylindrical rods may be PVC rods of about 3½" outer diameter (OD).

In embodiments, each of the two pins may be of a length between about 2½" and about 3½".

In embodiments, each of the two pins may have a diameter of between about ⅜" and about ¾", or between about ½" diameter and about ¾" diameter.

In embodiments, each of the two pins may have a length of about 3".

In embodiments, the pins may be formed of steel.

In embodiments, a center-to-center distance between the two pins is between about 3¾" and about 4".

The device may be provided separately for installation by the user with two hollow cylindrical rods for mounting between the pair of opposing brackets, which are cut to the desired length by the user. The device is configured such that the two hollow cylindrical rods, configured to be of appropriate length suitable to a length of a fence panel, may be mounted between the pair of opposing brackets to form a unit configured to place atop the fence panel intact and fixed thereto. Each end of an upper one of the two hollow cylindrical rods is mounted onto the upper pin of each opposing bracket, and each end of a lower one of the two hollow cylindrical rods is mounted onto the lower pin of each opposing bracket, the upper one and the lower one of the two hollow cylindrical rods.

In embodiments, the device also includes end caps with centrally positioned through-holes for fixedly mounting onto the ends of the two cylindrical rods. The through-holes are sized and configured to allow the ends of each of the upper and lower cylindrical rods to freely rotate around the upper pins and the lower pins respectively in use.

The present disclosure is also directed to a kit including any of the embodiments of a pair of opposing brackets of the present disclosure, two fastening elements, and the two cylindrical rods, each of the two cylindrical rods having a predetermined length configured to fit atop a fence panel of a fence system.

In embodiments, the kit also includes end caps with centrally positioned through-holes for fixedly mounting onto the ends of the two cylindrical rods.

The present disclosure also relates to a method for installing a canine containment device onto a fence. A method of installing an embodiment of the device of the disclosure on a fence panel of a fence and securing the device in position includes: adjusting a length of two hollow cylindrical rods to a length less than a distance between adjacent posts of the fence; positioning the open ends of each of the two hollow cylindrical rods, an upper and a lower cylindrical rod, onto and over upper pins and lower pins, respectively, extending from and fixed to each of the pair of opposing brackets; pushing the pair of opposing brackets toward each other, and mounting the device as assembled, intact, onto a top of the fence panel and between the adjacent posts via the mounting portions of the opposing brackets; and sliding each of the opposing brackets outward until each rests flush against the adjacent post.

The present disclosure also relates to a method for installing a canine containment device onto a fence. A method of installing an embodiment of the device of the disclosure on a fence panel of a fence and securing the device in position includes: adjusting a length of two hollow cylindrical rods to a length less than a distance between adjacent posts of the fence; fixedly mounting end caps having a through-hole centered therethrough over each of the ends of the hollow cylindrical rods, an upper and a lower cylindrical rod; positioning the through-holes of the endcaps of each of upper and the lower cylindrical rod onto and over upper and lower pins, respectively, that extend from each of a pair of opposing brackets, a left bracket and a right bracket, so that the pins extend into the hollow cylindrical rods, the through-holes on each of upper and the lower cylindrical rods being configured to freely rotate around the upper and lower pins, respectively. The method further includes pushing the pair of opposing brackets toward each other, and mounting the device as assembled, intact, onto a top of the fence panel and between the adjacent posts via the mounting portions of the opposing brackets; and sliding each of the opposing brackets outward until each rests flush against the adjacent fence post.

The method may further include installing a first device on a first fence panel and a second device onto a second, adjacent fence panel according to the afore-mentioned steps, wherein each of the left and right brackets of each of the first device and the second device has two outwardly positioned parallel plates with a vertically aligned slot therebetween. The method further includes inserting a blocking panel concurrently in both the slot of the right bracket of the first device and the slot of the left bracket of the second device to fill a gap above a fence post between the first device on the first fence panel and the second device on the second adjacent fence panel.

The method, in aspects, may further include tightening a fastening element inserted in each mounting portion of each of the left bracket and the right bracket against the fence panel to secure the device in position.

The present disclosure is also directed to a device configured for installation on a fence panel of a fence for canine containment. The device includes a pair of brackets, each bracket including a mounting portion configured for mounting on a fence panel and a support plate extending upward from the mounting portion; two pins extending perpendicularly from a first side of the support plate of each bracket, the two pins including an upper pin and a lower pin aligned in a vertical plane; and two hollow cylindrical rods positioned between the pair of brackets with the first side of the support plate of each bracket in the pair facing each other. Each end of an upper one of the two hollow cylindrical rods is rotatably mounted onto the upper pin of each bracket, and each end of a lower one of the two hollow cylindrical rods is rotatably mounted onto the lower pin of each bracket. The pair of brackets with the two hollow cylindrical rods mounted therebetween form a unit configured to place atop a fence panel intact and fixed thereto.

The support plate of each bracket, in embodiments, includes a second side facing outward from the first side and two parallel plates extending vertically outward from the second side and forming a slot therebetween.

In further embodiments, the device includes a blocking panel removably positioned vertically within the slot between, and parallel to, the two parallel plates.

In embodiments, an end cap is fixedly positioned over each end of the upper one and the lower one of the two hollow cylindrical rods. Each end cap has a through-hole positioned in a center of the end cap. The upper pin and the lower pin of each bracket in the pair of brackets is inserted through the through-hole of the end cap fixedly positioned over each end of the upper one and the lower one of the two hollow cylindrical rods, so that each of the upper one and the lower one of the two hollow cylindrical rods is rotatably connected to the upper pin and the lower pin, respectively, of each bracket in the pair of brackets via the through-hole in the end caps. A diameter of the through-hole corresponding to each end of the upper one and the lower one of the two hollow cylindrical rods is configured to allow free rotation of the upper one and the lower one of the two hollow cylindrical rods around the upper pin and the lower pin, respectively, of each bracket in the pair of brackets.

An outer cylindrical surface of each of the upper one and the lower one of the two hollow cylindrical rods may be smooth, and, in further embodiments, may be commercial polyvinyl chloride pipes.

In embodiments, each of the two hollow cylindrical rods has an outer diameter of about 3½ inches.

The device, in embodiments, may further include a fastening element configured to secure the device in position on the fence panel via the mounting portion of each bracket in the pair. The mounting portion may include a top surface extending parallel to and beneath the upper and lower pins, and a first vertical wall and a second vertical wall extending downward from the top surface. Each of the first vertical wall and the second vertical wall include a through-aperture configured to insert the fastening element therethrough.

A spacing between an outer diameter of the lower one of the two hollow cylindrical rods and the top surface of the mounting portion of each bracket in the pair of brackets, in embodiments, is between about ¼ inch and ½ inch.

In embodiments, each of the two hollow cylindrical rods has an outer diameter of about 3½ inches, wherein each of the upper pin and the lower pin is of a length between about 2½ inches and about 3½ inches, and a diameter of between about ½ inch and about ¾ inch; and wherein a center-to-center distance between the two pins is between about 3¾ inches and about 4 inches.

The present disclosure is also directed to a system for canine containment configured for installation on a fence having a plurality of fence panels and fence posts separating adjacent fence panels. The system includes two devices including a first device and a second device, each of the first device and the second device configured to place atop a first one and a second one of two adjacent fence panels, respectively, intact and fixed thereto. Each of the first device and the second device includes a left bracket and a right bracket, each including a mounting portion configured for mounting on each of the first one and the second one of the two adjacent fence panels and a support plate extending upward from the mounting portion. The support plate includes a first side and a second side opposite the first side. Each of the first device and the second device also includes two pins extending perpendicularly inward from the first side of the support plate of each of the left bracket and the right bracket, the two pins including an upper pin and a lower pin aligned in a vertical plane; and two hollow cylindrical rods positioned in vertical alignment between the left bracket and the right bracket. The first side of the support plate of the left bracket faces the first side of the support plate of the right bracket. A left end and a right end of an upper one of the two hollow cylindrical rods is each rotatably mounted onto the upper pin of the left bracket and the right bracket, respectively. A left end and a right end of a lower one of the two hollow cylindrical rods is each rotatably mounted onto the lower pin of the left bracket and the right bracket, respectively.

In embodiments, the second side of the support plate of each of the left bracket and the right bracket includes two parallel plates extending vertically outward from the second side and forming a slot therebetween.

In embodiments, a blocking panel is removably positioned vertically and aligned within the slot of the support plate of the right bracket of the first device and the slot of the support plate of the left bracket of the second device, the blocking panel filling a gap between the right bracket of the first device and the left bracket of the second device in use.

Each of the first device and the second device of the system further include, in embodiments, a left end cap and a right end cap fixedly positioned over the left end and the right end, respectively, of each of the upper one and the lower one of the two hollow cylindrical rods. Each of the left end cap and the right end cap has a through-hole that is centrally-positioned. Each of the upper pin and the lower pin of each of the left bracket and the right bracket is inserted through the through-hole of the left end cap and the right end cap, respectively, of each of the upper one and the lower one of the two hollow cylindrical rods, each of the upper one and the lower one of the two hollow cylindrical rods being rotatably connected to the upper pin and the lower pin, respectively, of each of the left bracket and the right bracket via the through-hole in the left end cap and the right end cap. A diameter of the through-hole is configured to allow free rotation of the upper one and the lower one of the two hollow cylindrical rods around the upper pin and the lower pin, respectively, of each of the left bracket and the right bracket.

The blocking panel is configured, in embodiments, to extend, in use, from a top surface of the fence post separating the two adjacent fence panels to an upper surface of the upper one of the two hollow cylindrical rods.

In embodiments, each of the two hollow cylindrical rods has an outer diameter of about 3½ inches, each of the upper pin and the lower pin is of a length between about 2½ inches and about 3½ inches, and a diameter of between about ½ inch and about ¾ inch; and a center-to-center distance between the two pins is between about 3¾ inches and about 4 inches.

In further embodiments, an outer cylindrical surface of each of the upper one and the lower one of the two hollow cylindrical rods is smooth, and each of the two hollow cylindrical rods is a polyvinyl chloride pipe.

The system may further include, in embodiments, a fastening element configured to secure each of the first device and the second device in position on the two adjacent fence panels via the mounting portion of each of the left bracket and the right bracket of each of the first device and the second device. The mounting portion may further include a top surface extending parallel to and beneath the upper and lower pins, a first vertical wall and a second vertical wall extending downward from the top surface, and each of the first vertical wall and the second vertical wall may further include a through-aperture configured to insert the fastening element therethrough.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the following detailed description in conjunction with the accompanying drawings.

Figure 1:
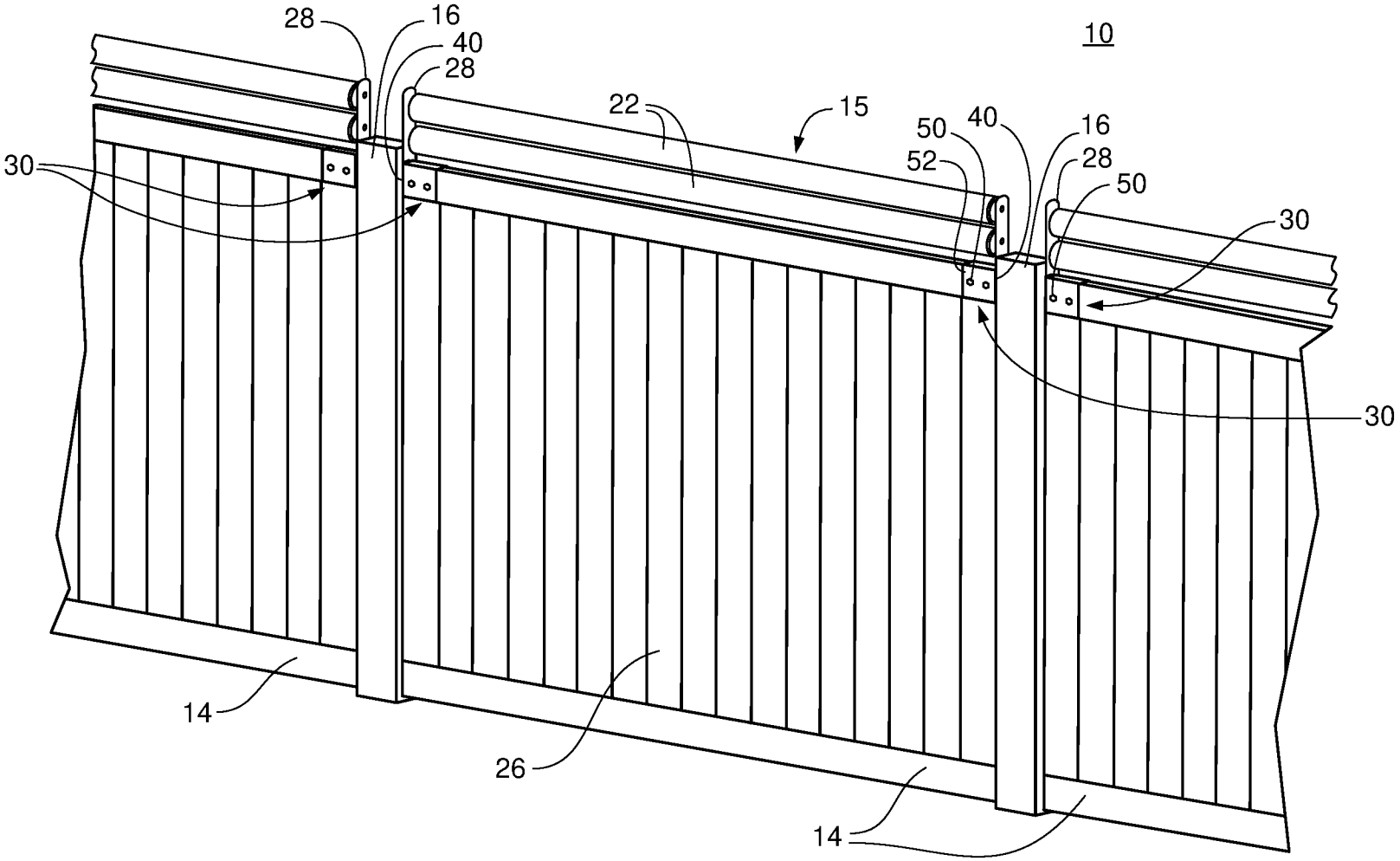
FIG. 1 is a perspective view of an embodiment of a fencing system of the present disclosure.

The various aspects of the present disclosure mentioned above are described in further detail with reference to the aforementioned figures and the following detailed description of exemplary embodiments.

DETAILED DESCRIPTION

The following sections describe exemplary embodiments of the present invention. It should be apparent to those skilled in the art that the described embodiments of the present invention provided herein are illustrative only and not limiting, having been presented by way of example only.

All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto.

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure of the invention as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items, devices, or apparatus are described as having, including, or comprising one or more specific components, elements, or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The present disclosure relates to a device, also referred to herein interchangeably as an apparatus, configured for attaching to a commercial fence that inhibits animals from scaling over the fence. The device may be configured to attach to any standard fence, and requires no tools or complicated mounting hardware to install.

The present disclosure also relates to a fencing system that includes a commercial fence and an embodiment of the device of the present disclosure configured for installation on the commercial fence.

It should be clear that while the embodiments of the device shown are configured for a PVC-type fence, having a flat horizontal upper surface, the device may also be configured for installation on other types of fences, for example, on chain link fences having a cylindrical horizontal upper surface.

It should be understood that the term "about" in reference to dimensions and sizes of elements of the device, such as the diameters of the hollow cylindrical rods, pins, and distances between the placement of elements such as the pins and cylindrical rods, accounts for the typical, well-known, manufacturing and machining tolerances, for example, in wall thicknesses of commercial steal pins and PVC pipes.

Referring to FIG. 1, an embodiment of a fencing system 10 includes a commercial fence 12, which further includes a plurality of fencing sections 14, referred to herein as fence panels 14, and a device 15 installed on a fence panel 14 that inhibits animals from scaling over the fence panel 14 from either side of the fence 12.

Embodiments of the fencing system 10 include a plurality of the devices 15, and a plurality of fence panels 14, each fence panel 14 including one of the plurality of the devices 15 installed onto a top edge of the fence panel 14. In embodiments, the fencing system 10 further includes posts 16, each post 16 being positioned between adjacent sections of fence panels 14. As one of skill in the art will appreciate, the commercial fence 12 may be assembled from individual posts 16 and fence panels 14, or in embodiments, each portion of the commercial fence 12 prior to assembly may include both one of the fence panels 14 and one of the posts 16 pre-attached thereto.

Figure 2:
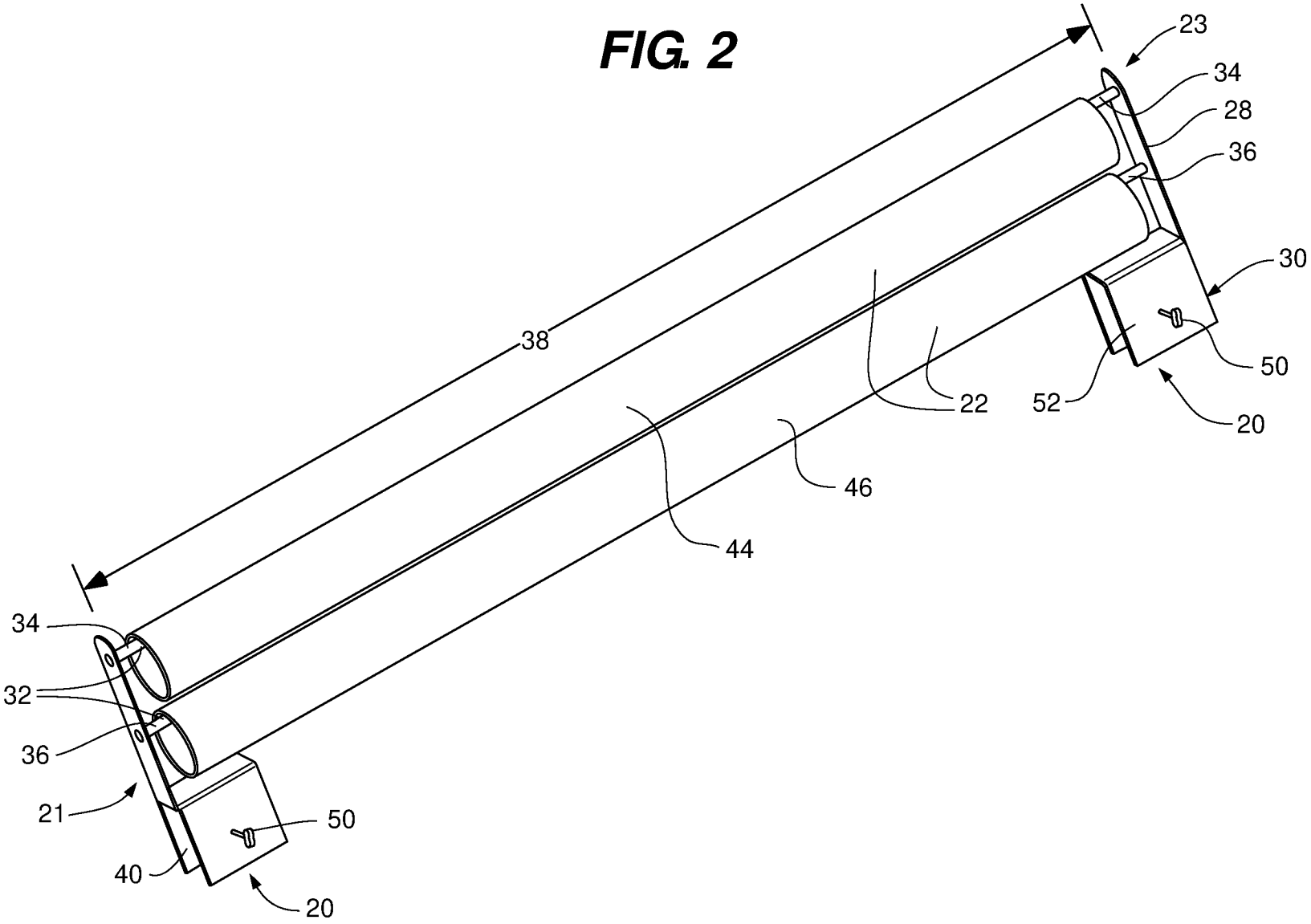
FIG. 2 is perspective view of an embodiment of a device of the present disclosure configured and assembled for installation on a section of a commercial fence as shown in the fencing system of FIG. 1.

Referring also to FIG. 2, the device 15 includes a pair of opposing brackets 20, also referred to herein as mounting brackets 20, forming end portions of the device 15. The pair of opposing brackets 20 may also be referred to herein as a left bracket 21 and a right bracket 23. In embodiments, the device 15 also includes at least two hollow cylindrical rods 22. In one embodiment, the device 15 includes two hollow cylindrical rods 22.

It should be noted that any of the embodiments of the device of this disclosure may be provided as a kit, which includes any of the embodiments of a pair of opposing brackets as described herein, as well as embodiments of the at least two hollow cylindrical rods, which may be cut to pre-determined lengths based on the length of the fence panel on which the device will be installed.

In embodiments, any of the embodiments of the pair of opposing brackets may be provided as described herein, preferably with mounting hardware, such as, but not limited to, fastening elements 50, and a user may cut two standard PVC tubes to the predetermined length required for the at least two hollow cylindrical rods based on the length of the fence panel the assembled device will be installed on.

Figure 3:
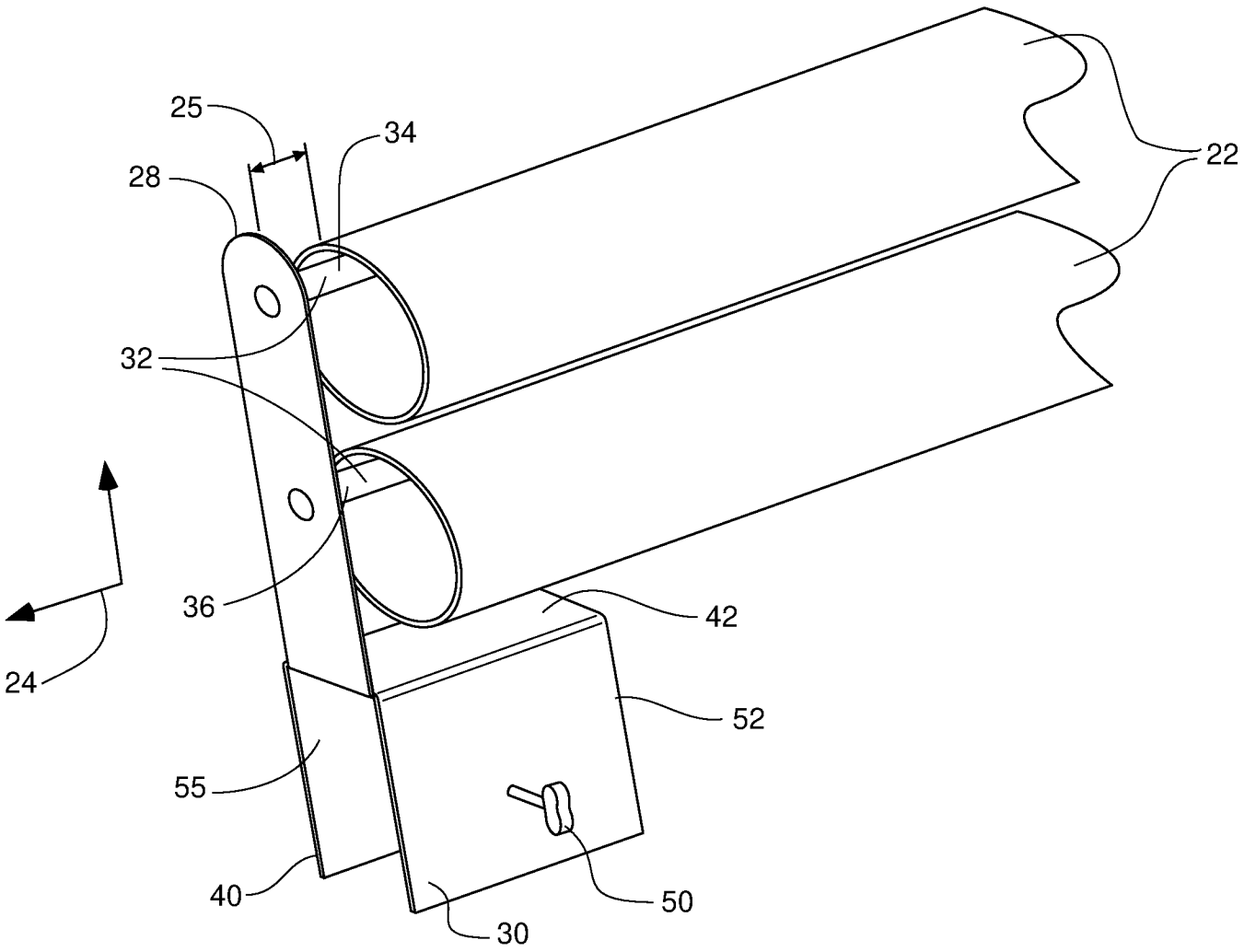
FIG. 3 is a magnified view of a portion of the device of FIG. 2.
Figure 5:
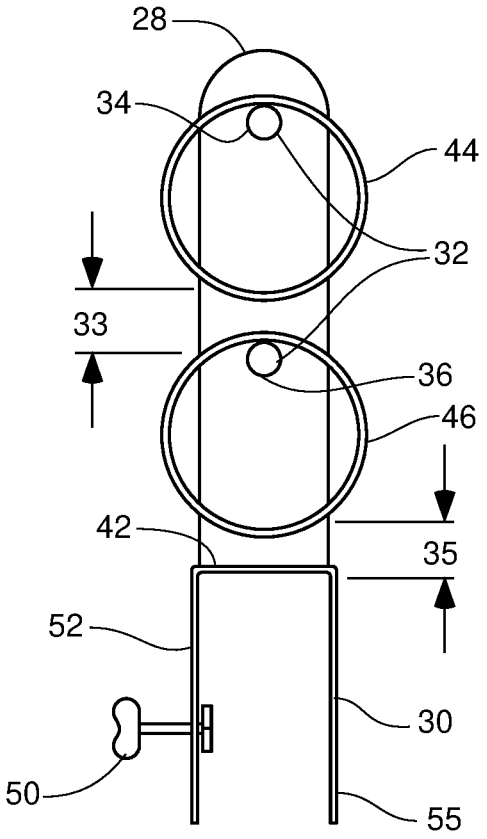
FIG. 5 is an end-view representation of the device assembled for installation as shown in FIG. 2 showing the juxtaposition of elements of the device.

As can be seen in FIGS. 2, 3 and 5, for example, when the device 15, or other embodiments such as device 115, is assembled for use, the at least two hollow cylindrical rods 22 are preferably positioned in parallel and also, in embodiments, aligned along the same vertical plane parallel to the surface 26 of the fence 12 (see FIG. 1).

Referring to FIGS. 2-5, each opposing bracket 20 includes a support plate 28 and a mounting portion 30 positioned below the support plate 28 and extending perpendicularly from the support plate 28. Extending from the support plate 28 are two cylindrical protrusions or pins 32, including an upper pin 34 and a lower pin 36, in vertical alignment, parallel to the vertical plane 24. The pair of opposing brackets 20 is assembled in the device 15 with the pins 32 of each bracket facing inward toward each other.

In embodiments, referring to FIG. 2, for example, each end 17, 19, of each of an upper cylindrical rod 44 and a lower cylindrical rod 46 is rotatably mounted onto the upper pins 34 and lower pins 36, respectively, of the opposing brackets 20. The lower pin 36 on each of the pair of opposing brackets 20 is spaced sufficiently above the mounting portion 30 so that one of the hollow cylindrical rods 22 may be positioned to hang freely on the lower pin 36 of each opposing bracket 20 upon assembly. Similarly, the upper pin 34 on each of the pair of opposing brackets 20 is spaced sufficiently above the lower pin 36 so that one of the hollow cylindrical rods 22 may be positioned to hang freely on the upper pin 34 of each opposing bracket 20 upon assembly without contacting the hollow cylindrical rod 22 hanging from the lower pins 34.

Preferably, the device 15 is completely assembled with the cylindrical rods 22 positioned between the pair of opposing brackets 20 prior to installing the device 15 atop the fence, as shown in FIG. 2. Referring also to FIG. 1, upon assembly, a distance 38 between the pair of opposing brackets 20 is chosen to extend a full length of the fence panel 14, so that they are mounted flush against adjacent posts 16. The corresponding lengths of the hollow cylindrical rods 22 are preferably chosen to leave about ½" gap 25 (see FIG. 3) between each end and each bracket 20 upon installation.

It should be understood that the length of each cylindrical rod 22 plus twice the length of each gap 25 will equal the distance between the brackets 20 installed on the fence.

The cylindrical rods 22 may be cut from standard PVC pipe, for example, 3-inch inner diameter (ID), i.e., 3.5-inch outer diameter (OD) PVC pipe. The length of each rod 22 is preferably chosen so that, when centered between the opposing brackets 20, there is a gap 25 (see FIG. 3) that is less than about one inch between each end of each cylindrical rod 22 and the support plate 28 of each corresponding opposing bracket 20 and great enough to avoid the cylindrical rods 22 from catching the sides of the brackets 20. The gap 25 must also be at least less than half the length of each pin 32, and in embodiments, less than or equal to about ¼ the length of each pin 32, to prevent either end of either cylindrical rod 22 from falling off the pin 32.

In embodiments, the gap 25 on each side is between about ¼ inch and about 1 inch.

In embodiments, the gap 25 on each side, is at least ¼ inch and less than or equal to ¼ the length of each pin 32.

In embodiments, the gap 25 is about ½ inch and the length of each pin 32 is about 3 inches.

In embodiments, the length of each pin 32 is between about 2½" and 3½".

In embodiments, referring to FIG. 5, a vertical spacing between the O.D. of the cylindrical rods 22 is preferably between about ⅛" and ⅜" preferably, about ¼".

The outer diameter of the cylindrical rods 22, in embodiments, may be between about 3" and 4½". In additional embodiments, the cylindrical rods are standard 3" (ID) PVC piping having a 3.5" OD.

In embodiments, the length of each of the pins is about 3".

The diameter of each pin 32 is preferably at least 4 times smaller than the inner diameter of the hollow cylindrical rods to allow the hollow cylindrical rods 22 to freely shift vertically and horizontally, as well as to roll around each set of pins 32.

In embodiments, each of the two pins has a diameter of between about ⅜" and about ¾".

In embodiments, each of the two pins is about ½" diameter.

Referring to FIG. 5, the inventors have found that a combination of cylindrical rods 22 of 3½" OD, cut from standard PVC tubes, and having a spacing 33 between an upper 44 and lower 46 one of the cylindrical rods 22 of about ¼" between their outer walls, and also a spacing 35 between the lower cylindrical rod 46 and a top horizontal surface 42 of the mounting portion 30 of each bracket 20 of about ¼", was surprisingly successful in keeping animals from being able to gain the needed traction to scale and pull themselves over the wall. It has been observed that these dimensions appear to prevent a dog's paw from getting stuck between the cylindrical rods 22 and to also prevent the dog from gaining traction with either their hind legs or their front legs on a stable surface, e.g., the top of the fence panel 14. It was also found advantageous to use a diameter of the cylindrical rods 22 that is greater than the thickness of the fencing panel by at least an inch, and to add a sufficient number of the cylindrical rods 22 in vertical alignment to extend the fence height to at least about 5 feet 7 inches or about 5 feet 8 inches overall. Accordingly, while two cylindrical rods 22 were sufficient to deter even the most agile "jumpers" from scaling over a 5' high fence having the device 15 attached, at least another two, in embodiments, another three cylindrical rods for a total of five (5) cylindrical rods may be preferable for a 4' high fence.

Figure 4:
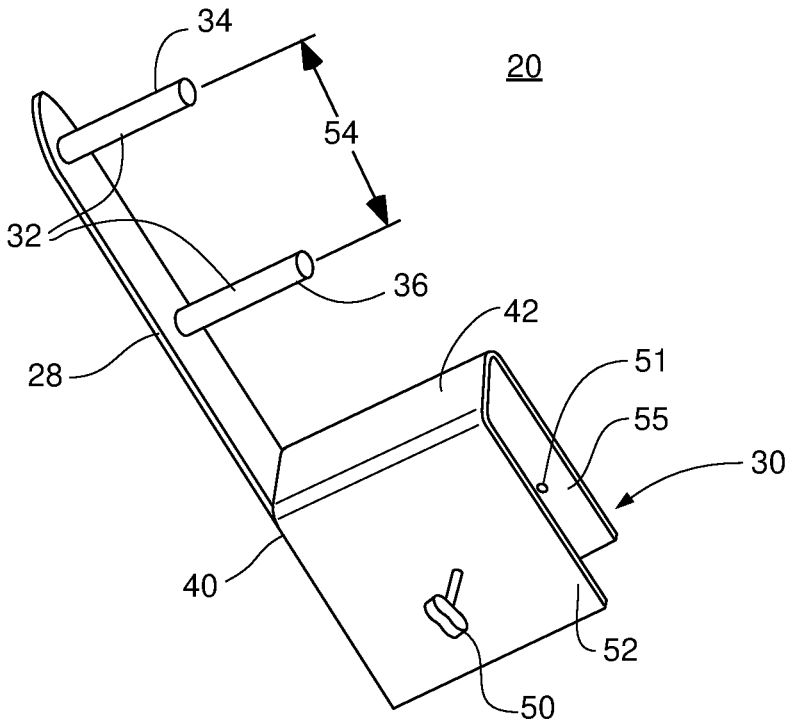
FIG. 4 is a perspective view of a mounting bracket of the device of FIG. 2, a pair of the mounting brackets forming an embodiment of the device of the present disclosure.

Referring to FIGS. 1, 3 and 4, the mounting portion 30, in embodiments, has an end portion 40 that is aligned in the plane of the support plate 28. The mounting portion 30 also has a top surface 42 that extends along the same horizontal direction as the pins 32, that is, parallel to and beneath the upper 34 and lower pins 36. When assembled in the device 15, the top surface 42 also extends below the cylindrical rods 22. The mounting portion 30 is configured with a shape that will fit atop one of the fence panels 14. For example, a U-shaped mounting portion 30 will fit onto most types of commercial fencing suitable for containing animals such as dogs.

Referring to FIGS. 3 and 5, the top surface 42 of the mounting portion 30 in the embodiments shown is a horizontal surface in use on the fence panel 14, and extends parallel to and beneath the pins 32, a first vertical wall 52 and a second vertical wall 55 extending vertically downward from the top surface 42 to form an upside down U-shape.

As shown in FIG. 1, the end portion 40 together with the support plate 28 with which it is aligned are configured to form a stop, such that the support plate 28 rests flush against one of the posts 16 of the fence 10 upon assembly of the device 15 on the fence panel 14. When the lengths of the cylindrical rods 22 are appropriately sized to the fence panel 14, the assembled device 15 of FIG. 2, for example, is initially placed on one of the fence panels 14 with the pair of opposing brackets 20 pushed together so that the cylindrical rods 22 abut the support plate 28 of each opposing bracket 20. The pair of opposing brackets 20 with the two hollow cylindrical rods 22 mounted therebetween thus form a unit, device 15, as shown in FIG. 2, configured to place atop a fence panel and fixed thereto, without the need for complicated hardware, springs, or complex assemblies to fix the device 15 to the fence. Once positioned on the fence panel 14, each opposing bracket 20 is then slid outward until the support plate 28 of each opposing bracket 20 abuts the adjacent fence post 16.

To accommodate this assembly and also to allow the cylindrical rods 22 to freely roll around the pins 32, the length of each of the pins 32 is preferably greater than about 2½". In embodiments, the length of each of the pins 32 is about 3".

A PVC-type fence has a flat top surface and rectangular profile, as shown in FIGS. 1 and 5, for example. For this and other types of fence, a fastening element 50, which may be a screw-bolt, for example, may be used to snugly retain the mounting portion 30 against the fence panel 14.

As shown in FIGS. 1-5, for example, embodiments of the device 15 may also include the fastening element 50 inserted through a vertical wall, for example, the first vertical wall 52 (see FIGS. 3-5) of the mounting portion 30. Once the device 15 is appropriately positioned on the fence panel 14, with each of the pair of the opposing brackets 20 abutting the fence post 16 adjacent thereto, the fastening element 50 may be tightened to hold the device 15 in place.

In embodiments, the fastening element 50 may include an adjustable clamp screw of suitable length. When the fastening element 50 is used to install the device 15, the mounting portion 30, for example, the U-shaped mounting portion 30 shown in the embodiments, does not need to be exactly sized for a tight fit onto the fence panel 14. A one-inch long adjustable clamp screw, for example, can securely maintain the device 15 onto fence panels 14 of standard two-inch thickness.

In embodiments, the fastening element 50 is configured to tighten against the fence panel 14 for a PVC-type fence. In other embodiments, a longer fastening element 50 may be used. The mounting portion 30 may include an aperture 51 (see FIGS. 4, 5) in the opposing, i.e., second vertical wall 55 so that the fastening element 50 can be inserted through the opposing vertical wall 55 and bolted into place. This embodiment is useful for both PVC fencing and the cylindrical chain-link type fencing, bearing in mind that the brackets should be tightened flush against the adjacent fence posts 16.

The fencing systems 10 best suited for installation of the device of the present disclosure include standard fences with fence sections 14 having a height of either 4', 5', or 6', and may be either residential or commercial grade. Additionally, the device 15 can be installed, in accordance with the methods described below, on PVC fencing and gates, and on other types of fencing, in varying custom cut widths of between approximately 2' to 6'.

In embodiments, the device 15 of the present disclosure is configured for installation on a fence panel 14 of a fence 10 for canine containment. The device 15 includes a pair of opposing brackets 20, each opposing bracket 20 including a mounting portion 30 configured for mounting on a fence panel 14, which may be PVC or other types, such as chain link, and a support plate 28 extending upward from the mounting portion 30. Each opposing bracket 20 also includes at least two pins 32 extending perpendicularly from the support plate 28 of each opposing bracket 20, the at least two pins 32 being aligned in the vertical plane 24.

In embodiments, each of the at least two pins 32 is of a length between about 2½" and about 3½", a diameter of between about ½" and about ¾", and a center-to-center distance 54 (see FIG. 4) between adjacent pins is between about 3¾" and about 4". Preferably, each cylindrical rod for this embodiment is of about 3.5" OD.

The device 15 may also include the fastening element 50 inserted and, in embodiments, captured in the mounting portion 30 of each bracket 20 to secure the device 15 in position on the fence panel 14.

A kit of the present disclosure may include the pair of opposing brackets 20 and at least two hollow cylindrical rods 22 for positioning between the pair of opposing brackets 20, so that each open end of each one of the at least two hollow cylindrical rods 22 hangs freely from an opposing set of pins 32 on the pair of opposing brackets 20. The pair of opposing brackets 20, together with the at least two hollow cylindrical rods 22 positioned and assembled therebetween, form a unit configured to place atop a fence panel 14 intact and fixed thereto.

The kit may be provided with the at least two hollow cylindrical rods 22 pre-cut for a particular commercial fence 10 with fence panels 14 of known, pre-determined width.

In embodiments, the brackets 20 of the present disclosure may be formed of aluminum.

In other embodiments, the brackets 20 may be steel.

The present disclosure is also directed to a method for installing a canine containment device, in embodiments, the device 15 shown in FIG. 2, onto a fence. The method includes adjusting a length of two hollow cylindrical rods 22 to a length based on a distance between adjacent posts 16 of the fence 10. The method further includes positioning the open ends of each of the two cylindrical rods, an upper 44 and a lower 46 cylindrical rod, onto and over upper pins 34 and lower pins 36, respectively, extending from and fixed to each of the pair of opposing brackets 20, such that each cylindrical rod 22 can roll freely around the pins 34, 36. The method includes next pushing the pair of opposing brackets 20 toward each other, and mounting the device 15, as assembled, onto a top of the fence panel 14 and between the adjacent posts 16 via the mounting portions 30 of the opposing brackets 20; and then sliding each of the opposing brackets 20 outward until each rests flush against the adjacent post 16.

In embodiments, the method further includes tightening a fastening element 50 in each mounting portion 30 to secure the device 15 in position. In embodiments the fastening element 50 is secured against the fence panel 14.

Figure 6:
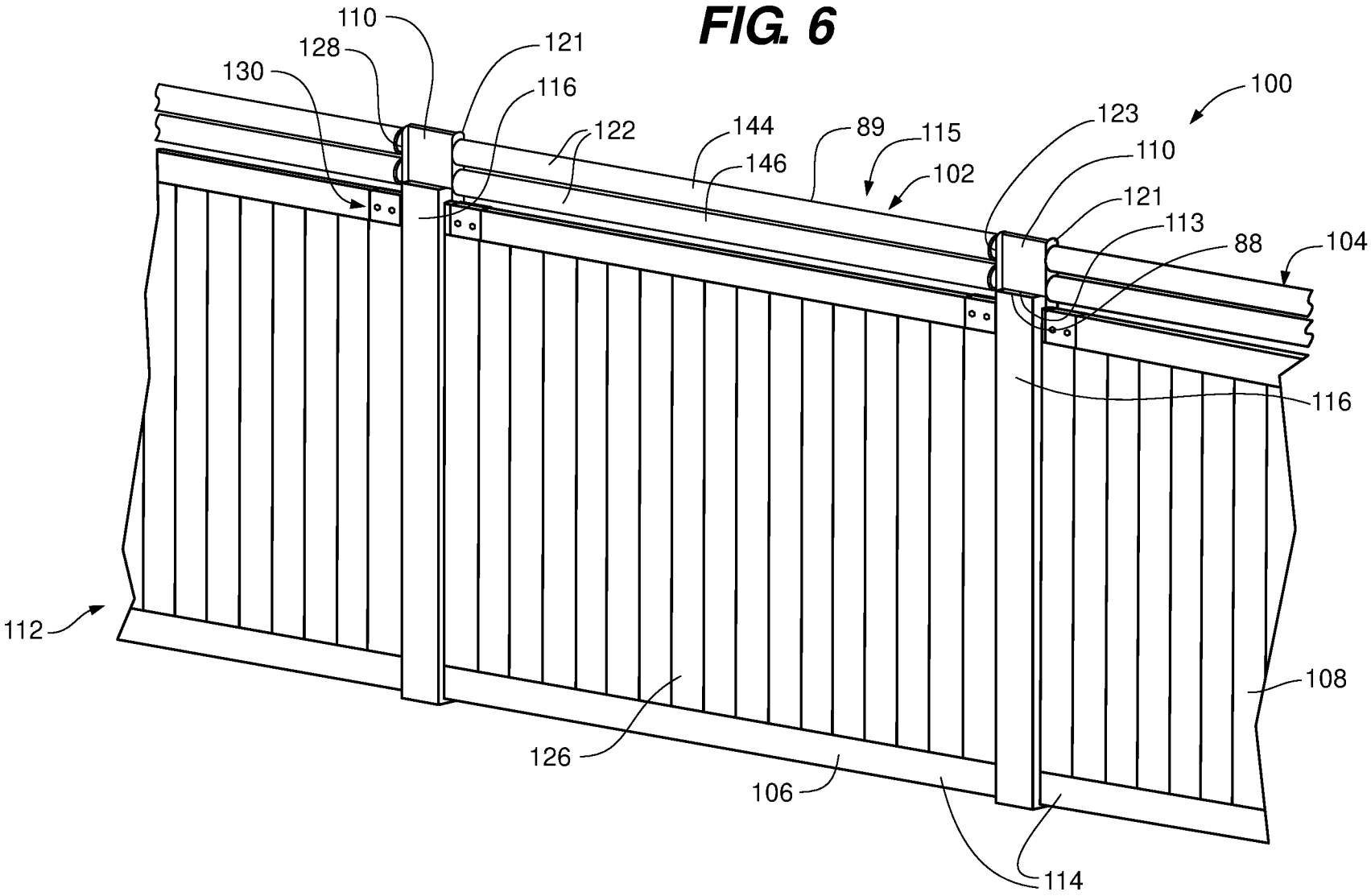
FIG. 6 is a perspective view of another embodiment of a fencing system of the present disclosure as installed on a fence.

FIG. 6 represents another embodiment of a system 100 of the present disclosure for installation on a commercial fence 112, which includes a plurality of fence panels 114. The system 100 includes an embodiment of a device 115, which when installed on the fence panel 114, inhibits animals from scaling over the fence panel 114 from either side of the fence 112.

Embodiments of the system 100 for canine containment may include a plurality of the devices 115, wherein each of the devices is configured for installation on one of the plurality of fence panels 114. In embodiments, the fence 112 further includes posts 116, each post 116 being positioned between adjacent sections of fence panels 114. As one of skill in the art will appreciate, the commercial fence 112 may be assembled from individual fence posts 116 and fence panels 114, or in embodiments, each portion of the commercial fence 112 prior to assembly may include both one of the fence panels 114 and one of the posts 116 pre-attached thereto.

Referring still to FIG. 6, for example, the system 100 in embodiments may include a first device 102 and a second device 104 configured to mount atop a first fence panel 106 and a second fence panel 108 that is adjacent to the first fence panel 106. The system 100, in embodiments, also includes a blocking panel 110 removably positioned between, and connected to, the first device and the second device. The blocking panel 110 is positioned over the fence post 116 and fills a gap 113 which would otherwise exist between the adjacent first 102 and second device 104 and above the fence post 116 when installed on the first 106 and second (adjacent) fence panel 108, respectively.

Figure 7:
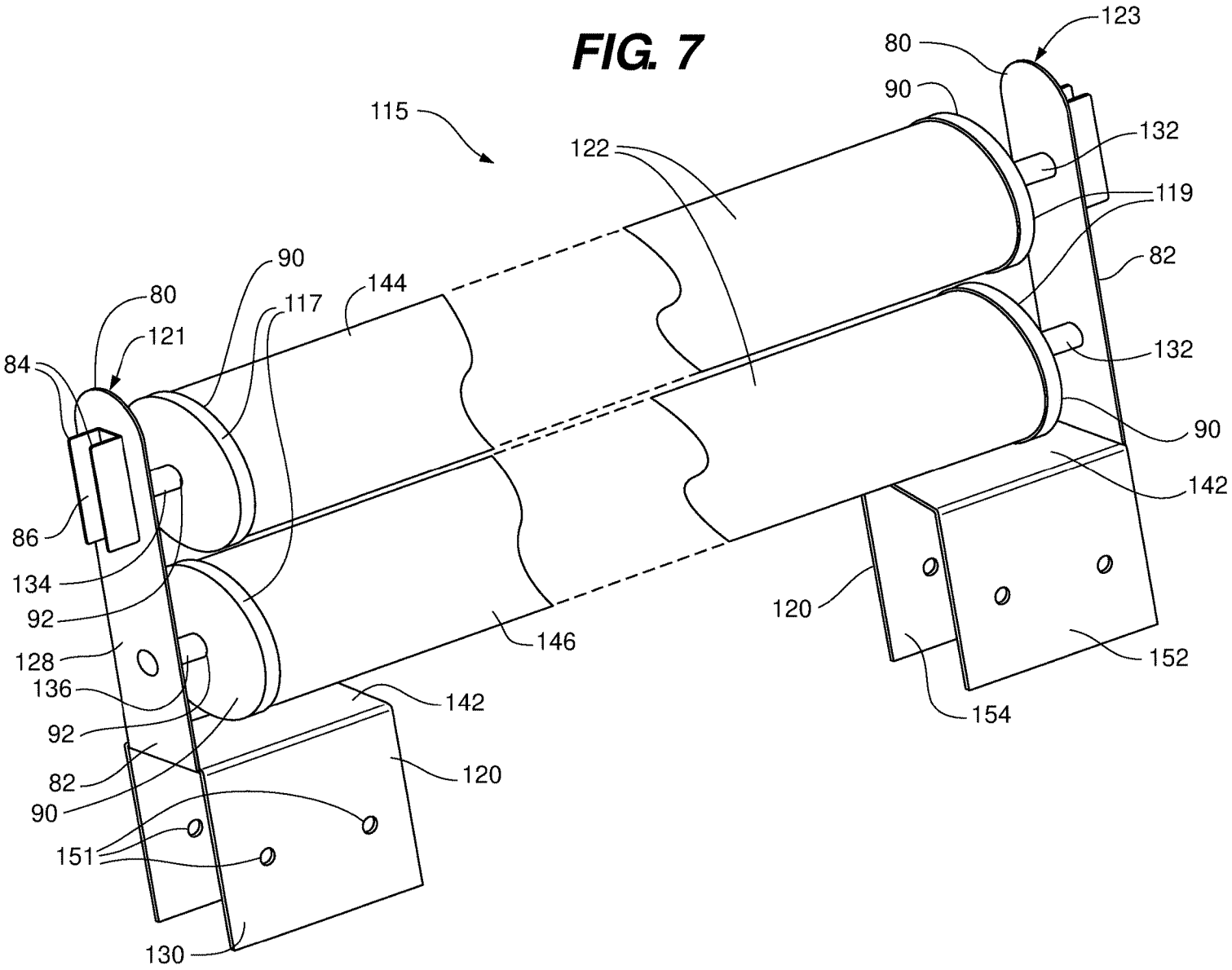
FIG. 7 is a portion of a magnified perspective view of the device and fencing system of FIG. 6.

Referring also to FIG. 7, the device 15 includes a pair of opposing brackets 120, also referred to herein as mounting brackets 120, forming end portions of the device 115. The pair of opposing brackets 120 may also be referred to herein as a left bracket 121 and a right bracket 123. In embodiments, the device 115 also includes at least two hollow cylindrical rods 122, including an upper cylindrical rod 144 and a lower cylindrical rod 146, preferably in vertical alignment, positioned between the left bracket 121 and the right bracket 123. In one embodiment, the device 115 includes only two hollow cylindrical rods 122.

Figure 10:
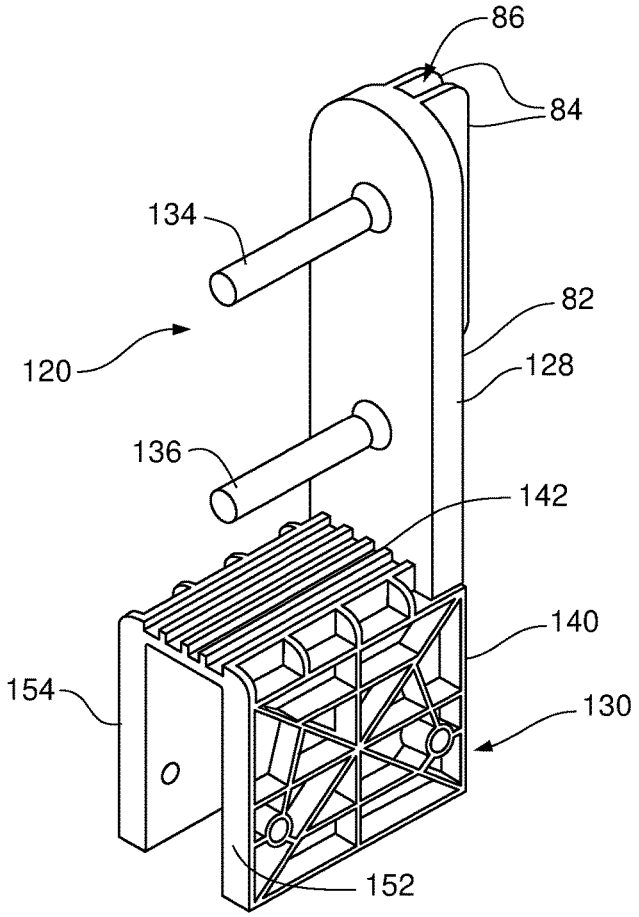
FIG. 10 is a perspective view of a mounting bracket of the device and system of FIGS. 6 and 7.
Figure 11:
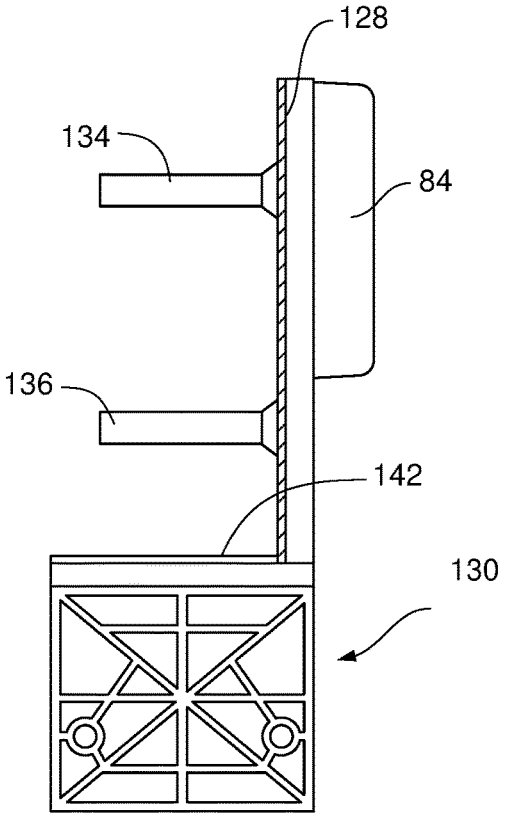
FIG. 11 is a right side view of the mounting bracket of FIG. 10.

Referring to FIGS. 6, 7 and 10, for example, each opposing bracket 120 includes a support plate 128 and a mounting portion 130 positioned below the support plate 128 and extending downward, and perpendicularly inward, from the support plate 128. The support plate 128 extends vertically upward from the mounting portion 130, and upward from the fence panel 114 when in use. The mounting portion 130 is configured to mount on the fence panel 114.

Each of the opposing brackets 120 in the device 115 is positioned upon assembly to form an end portion of the device 115. Referring to FIGS. 7 and 10, for example, the support plate 128 of each bracket 120 includes a first (inner) side 80, wherein the first side 80 of each of the left 121 and the right bracket 123 face each other in use, as assembled on the fence panel 114. Each support plate 128 also includes a second (outer) side 82, which faces outward from the first side 80 and toward the adjacent fence post 116 in use, as assembled on the fence panel 114.

Referring still to FIGS. 7 and 10, two cylindrical protrusions or pins 132, including an upper pin 134 and a lower pin 136, extend perpendicularly inward from the first side 80 of the support plate 128 of each of the left bracket 121 and right bracket 123 of the device 115. The upper pin 134 is parallel to the lower pin 136 and both are aligned in a vertical plane with the fence panel 114. The pair of opposing brackets 120 are assembled in the device 115 with the pins 132, and first sides 80, of each bracket 120 facing inward toward each other.

In embodiments, as shown and described herein, the pins 132 extend inward only from the first side 80 of the support plate 28 of each bracket 120.

In embodiments, referring to FIG. 7, for example, each end 117, 119, of each of the upper cylindrical rod 144 and the lower cylindrical rod 146 is rotatably mounted onto the upper pins 34 and lower pins 36, respectively, of the opposing pair of brackets 120.

Referring to FIGS. 7-10, for example, in further embodiments, the second side 82 of each of the left bracket 121 and right bracket 123 of the device 115 also includes two parallel plates 84 extending vertically outward from the second side 82, forming a slot 86 between the parallel plates 84.

Referring also to FIG. 6, the blocking panel 110 of embodiments of a system of the present disclosure may be removably positioned vertically and aligned within both of the slots 86 of the right bracket 123 of the first device 102 and the left bracket 121 of the second device 104. The blocking panel 110 is configured to fill the gap 113 which would otherwise exist between the right bracket 123 of the first device 102 and the left bracket 121 of the second device 104, when installed for use.

In this way the blocking panel 110 is positioned over the fence post 116 between adjacent fence panels 114. The blocking panel 110 visually elevates the fence post 116, from the perspective of an animal looking to escape the fenced-in area, to the top of the upper cylindrical rod 144. In addition, the blocking panel 110 provides a physical barrier across the top of the fence post 116 and between the adjacent devices 115. Advantageously, the blocking panel 110 can be easily slid into place over every fence post 116 after installation of the devices 115 on the fence panels 114.

In embodiments, referring to FIG. 6, the blocking panel 110 is configured to extend, in use, from a top surface 88 of the fence post 116 separating the two adjacent fence panels to an upper surface 89 of the upper one 144 of the two hollow cylindrical rods 122.

Figure 8:
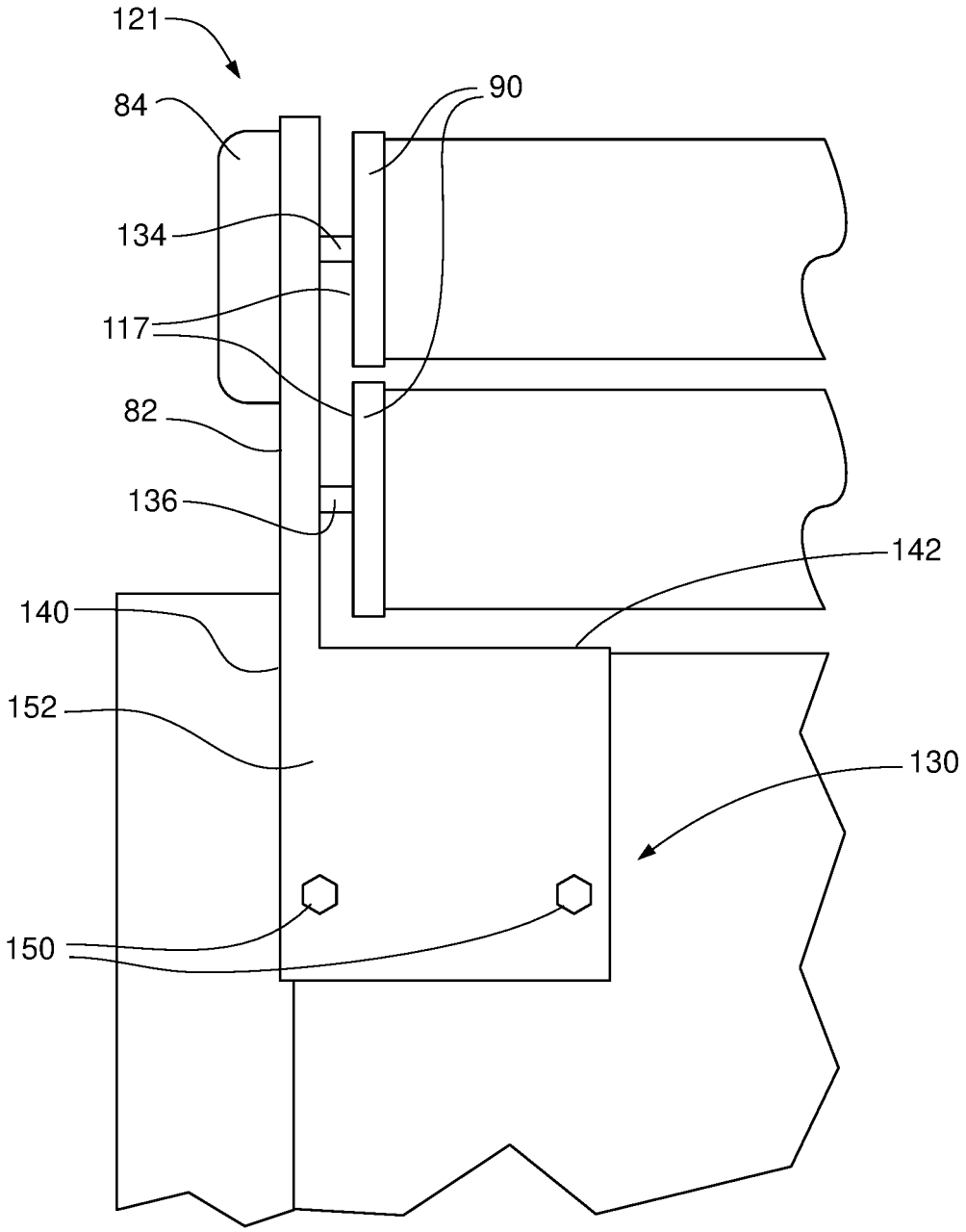
FIG. 8 is a view of a magnified portion of the fencing system of FIG. 6 as installed from a front of the fence.
Figure 9:
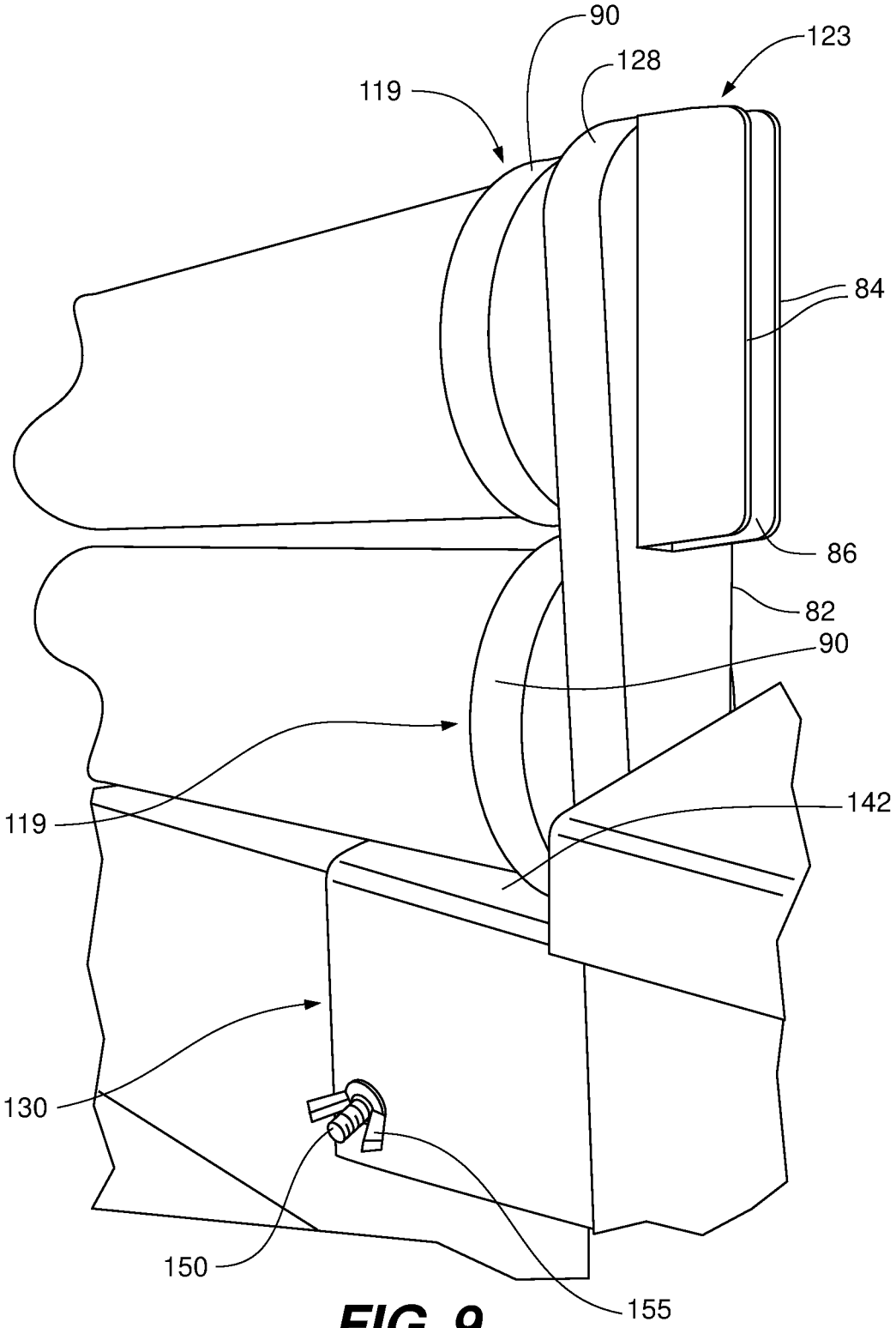
FIG. 9 is a perspective view of a portion of the fencing system of FIG. 6 as installed from a back of the fence.

In further embodiments of the device 115, as best seen in FIGS. 7, 8, and 9, each end 117, 119 of each cylindrical rod 122 includes an end cap 90 fixedly positioned over each end 117, 119. One of skill in the art will appreciate that such end caps are commercially available and configured to fit over standard PVC piping. As best shown in FIG. 7, each end cap 90 also includes a through-hole 92 positioned in a center of the end cap 90. The upper pin 134 of each of the left bracket 121 and the right bracket 123 is inserted through the through-hole 92 of each end cap 90 that is fixedly positioned over each end 117, 119, of the upper cylindrical rod 144. Similarly, the lower pin 136 of each of the left bracket 121 and the right bracket 123 is inserted through the through-hole 92 of each end cap 90 that is fixedly positioned over each end 117, 119, of the lower cylindrical rod 146.

Accordingly, still referring to FIG. 7, each of the upper one 144 and the lower one 146 of the two hollow cylindrical rods 122 is rotatably connected to the upper pin 134 and the lower pin 136, respectively, of each of the left 121 and right bracket 123 in the pair of brackets 120 via the through-hole 92 in the end caps 90. A diameter of the through-hole 92 corresponding to each end of the upper one 144 and the lower one 146 of the two hollow cylindrical rods 122 is preferably configured to allow free rotation of the upper one 144 and the lower one 146 of the two hollow cylindrical rods 122 around the upper pin 134 and the lower pin 136, respectively, of each of the left bracket 121 and the right bracket 123 in the pair of brackets 120 of the device 115.

The spacing between the upper pin 134 and lower pin 136 on each bracket 120, and between the lower pin 136 and the mounting portion 130 of each of the brackets 120, together with the sizing of the cylindrical rods 122, are also important to allow free rotation of each of the upper 144 and lower cylindrical rod 146 around the upper 134 and lower pin 136 on each of the pair of opposing brackets 120.

In embodiments, the lower pin 136 on each of the pair of opposing brackets 120 is spaced sufficiently above the mounting portion 130 so that the lower one 146 of the hollow cylindrical rods 122 may be positioned to rotate freely on the lower pin 36 of each opposing bracket 120 upon assembly without brushing against the mounting portion 130. Similarly, the upper pin 134 on each of the pair of opposing brackets 120 is spaced sufficiently above the lower pin 136 so that the upper 144 and lower one 146 of the hollow cylindrical rods 122 may rotate freely without contacting each other, but the spacing should also be sufficiently small to prevent a canine or other animal from getting its paws stuck between the hollow cylindrical rods 122 in use.

Preferably, the device 115 is completely assembled with the cylindrical rods 122 positioned between the pair of opposing brackets 120 prior to installing the device 115 atop the fence, as shown in FIG. 7. Like the embodiment shown in FIG. 2, upon assembly, a distance 38 between the pair of opposing brackets 20, or brackets 120, is chosen to extend a full length of the fence panel 114, so that the brackets 120 are mounted flush against adjacent posts 116. The combined length of each of the hollow cylindrical rods 122 with end caps 90 mounted onto their ends 117, 119 are preferably chosen to leave about ½" gap between each end and each bracket 120 upon installation.

The cylindrical rods 122 of the embodiment of FIGS. 6-12 may also be cut from standard polyvinyl chloride (PVC) pipe, for example, 3-inch standard PVC, which has an inner diameter (ID) of about 3", and an outer diameter (OD) of about 3½". The length of each rod 122, in embodiments, may be chosen so that, when centered between the opposing brackets 120, there is a gap that is less than about one inch between each endcap 90 on each cylindrical rod 122 and the support plate 128 of each corresponding opposing bracket 120 and great enough to avoid the cylindrical rods 122 from catching the sides of the brackets 120. The gap, in embodiments, is also at least less than half the length of each pin 132, and in embodiments, less than or equal to about ¼ the length of each pin 132, to prevent the pin 132 from dislodging from the through-hole 92 in either endcap 90 of either cylindrical rod 122.

Figure 12:
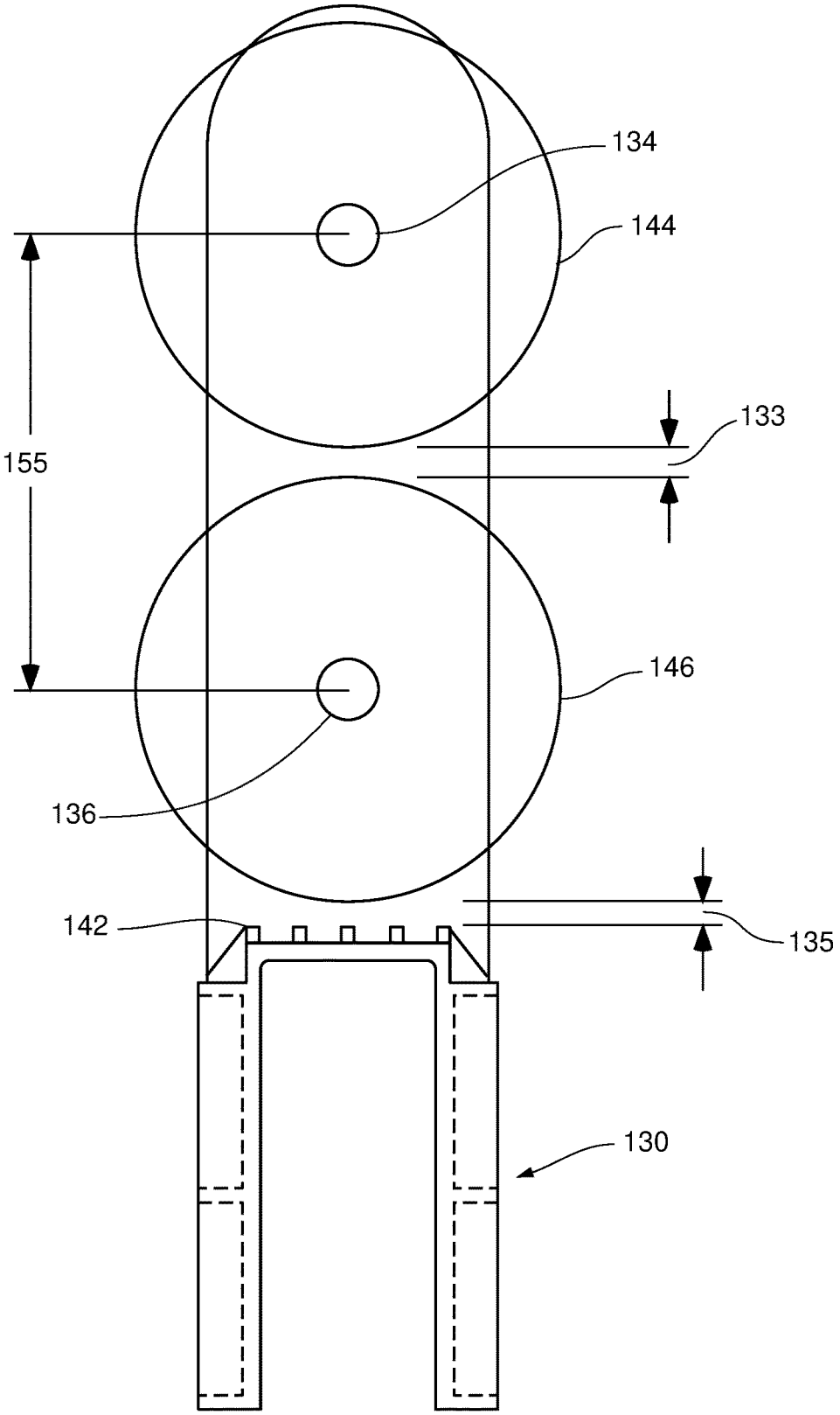
FIG. 12 is an inner end portion view of the mounting bracket of FIG. 10, showing a first (inner) side of the support plate, which also depicts the juxtaposition of the cylindrical rods on the mounting bracket.

In embodiments, referring to FIG. 12, a vertical spacing 133 between the O.D. of the cylindrical rods 122 installed on the upper 134 and lower pins 136 is preferably between about ⅛" and ⅜" preferably, about ¼".

The outer diameter of the cylindrical rods 122, in embodiments, may be between about 3" and 4½". In additional embodiments, the cylindrical rods are standard 3" (ID) PVC piping having an outer diameter of about 3.5".

In embodiments, the length of each of the pins is about 3".

In embodiments, each of the two pins has a diameter of between about ⅜" and about ¾".

In embodiments, each of the two pins is about ½" diameter.

Referring to FIG. 12, the inventors have found that a combination of two hollow cylindrical rods 122 of 3½" OD, cut from standard PVC tubes, with end caps 90 with centered through-holes 92 fixedly mounted onto their ends 117, 119, and having a spacing 133 between the upper 144 and the lower 146 one of the cylindrical rods 122 of about ¼" between their outer walls, and also a spacing 135 between the lower cylindrical rod 146 and a top (horizontal) surface 142 of the mounting portion 130 of each bracket 20 of about ¼", was surprisingly successful in keeping animals from being able to gain the needed traction to scale and pull themselves over the wall. It has been observed that these dimensions appear to prevent a dog's paw from getting stuck between the cylindrical rods 122 and to also prevent the dog from gaining traction with either their hind legs or their front legs on a stable surface, e.g., the top of the fence panel 114. It was also found advantageous to use a diameter of the cylindrical rods 122 that is greater than the thickness of the fencing panel by at least an inch, and to add a sufficient number of the cylindrical rods 122 in vertical alignment to extend the fence height to at least about 5 feet 7 inches or about 5 feet 8 inches overall. Accordingly, while two cylindrical rods 122 were sufficient to deter even the most agile "jumpers" from scaling over a 5' high fence having the device 115 attached, at least another two, in embodiments, another three cylindrical rods for a total of five (5) cylindrical rods may be preferable for a 4' high fence.

In embodiments, each of the upper 144 and lower cylindrical rod 146 is formed of polyvinyl chloride (PVC).

In embodiments, the outer cylindrical surface of each of the upper 144 and lower cylindrical rods 146 are smooth.

Referring to FIGS. 8-11, the mounting portion 130, in embodiments, has an end portion 140 that is aligned in the plane of the support plate 128. The mounting portion 130 also has a top surface 142 that extends along the same horizontal direction as the pins 132, that is, parallel to and beneath the upper 134 and lower pins 136. When assembled in the device 115, the top surface 142 also extends below the cylindrical rods 122. The mounting portion 130 is configured with a shape that will fit atop one of the fence panels 114. For example, a U-shaped mounting portion 130 will fit onto most types of commercial fencing suitable for containing animals such as dogs.

Referring to FIGS. 7 and 10, the top surface 142 of the mounting portion 130 in embodiments is a horizontal surface that extends parallel to and beneath the pins 132. The mounting portion 130 also includes a first vertical wall 152 and a second vertical wall 154 extending vertically downward from the top surface 142 to form an upside down U-shape.

With reference also to FIG. 6, the end portion 140 together with the support plate 128 with which it is aligned are configured to form a stop, such that the support plate 128 rests flush against one of the posts 116 of the fence 112 upon assembly of the device 115 on the fence panel 114. When the lengths of the cylindrical rods 122 are appropriately sized to the fence panel 114, the assembled device 115 of FIG. 7, for example, is initially placed on one of the fence panels 114 with the pair of opposing brackets 120 pushed together so that the cylindrical rods 122, with the end caps 90 mounted onto their ends 117, 119, abut the support plate 128 of each opposing bracket 120. The pair of opposing brackets 120 with the two hollow cylindrical rods 122 mounted therebetween thus form a unit, device 115, as shown in FIG. 7, configured to place atop a fence panel and fixed thereto, without the need for complicated hardware, springs, or complex assemblies to fix the device 115 to the fence 112. Once positioned on the fence panel 114, each opposing bracket 20 is then slid outward until the support plate 128 of each opposing bracket 120 abuts the adjacent fence post 16.

A PVC-type fence has a flat top surface and rectangular profile, as shown in FIGS. 1 and 6, for example. For this and other types of fence, a fastening element 150, which may be a screw-bolt (see FIGS. 8, 9, for example), may be used to snugly retain the mounting portion 130 against, or onto, the fence panel 114.

Referring, for example, to FIGS. 7-10, embodiments of the device 115 may also include at least one fastening element 150 inserted through a vertical wall, for example, the first vertical wall 152 of the mounting portion 130. Once the device 115 is appropriately positioned on the fence panel 114, with each of the pair of the opposing brackets 120 abutting the fence post 116 adjacent thereto, the fastening element 150 may be tightened to hold the device 115 in place.

Embodiments of the device 115 and of the system 100 may include, for example, a fastening element 150 in the mounting portion 130 of each of the left bracket 121 and the right bracket 123 of each of the first device 102 and the second device 104 configured to secure each of the first device 102 and the second device 104 in position on the first 106 and second (adjacent) fence panel 108. The mounting portion 130, as described herein, may include the top surface 142 extending parallel to and beneath the upper 134 and lower pin 136, with the first vertical wall 152 and the second vertical wall 154 extending downward from the top surface 142. As shown in FIG. 7, for example, each of the first vertical wall 152 and the second vertical wall 154 includes a through-aperture 151 configured to insert the fastening element 150 therethrough.

In embodiments, the fastening element 150, or preferably two fastening elements 150, may be inserted through two adjacently spaced through-apertures 151 as shown in FIG. 7. The fastening elements 150 may include threaded bolts inserted through the through-apertures 151 of both the first vertical wall 152 and the second vertical wall 154. The threaded bolt is sized in length to extend through both the first vertical wall 152 and the second vertical wall 154. The device 115 may be secured to the fence panel 114 by tightening and bolting the second vertical wall 154 against the fence panel 114 by attaching and tightening a nut, preferably a wing-nut 155, onto the portion of the threaded bolt that extends through the aperture 151 of the second vertical wall 154.

Fencing 112 best suited for installation of the device of the present disclosure include standard fences with fence sections 114 having a height of either 4', 5', or 6', and may be either residential or commercial grade. Additionally, the device 115 can be installed, in accordance with the methods described below, on PVC fencing and gates, and on other types of fencing, in varying custom cut widths of between approximately 2' to 6'.

In embodiments, the brackets 120 of the present disclosure may be formed of aluminum.

In other embodiments, the brackets 120 may be steel.

The present disclosure is also directed to a method for installing a canine containment device, in embodiments, the device 115 shown in FIG. 7, onto a fence. The method includes adjusting a length of two hollow cylindrical rods 122 to a length based on a distance between adjacent posts 116 of the fence panel 114. The method further includes fixedly mounting end caps 90 having a through-hole 92 centered therethrough over each of the ends 117, 119 of the hollow cylindrical rods 122, an upper 144 and a lower cylindrical rod 146.

The method further includes positioning the through-holes 92 of the endcaps of each of upper 144 and the lower cylindrical rod 146 onto and over the upper 134 and lower pins 136, respectively, that extend from each of a pair of opposing brackets 120 (left bracket 121 and right bracket 123) so that the pins 134, 136 extend into the hollow cylindrical rods 144, 146. The through-holes 92 on the end caps 90 of each of upper 144 and the lower cylindrical rods 146 are configured to freely rotate around the upper 134 and lower pins 136, respectively. The method includes next pushing the pair of opposing brackets 120 toward each other, and mounting the device 115, as assembled, onto a top of the fence panel 114 and between the adjacent posts 116 via the mounting portions 130 of the opposing brackets 120; and then sliding each of the opposing brackets 120 outward until each rests flush against the adjacent post 116.

In embodiments, the method further includes tightening the fastening element 150 in each mounting portion 130 to secure the device 115 in position.

In additional embodiments, the method may further include installing the first device 102 on the first fence panel 106 and the second device 104 onto the second, adjacent fence panel 108 according to the afore-mentioned steps, wherein each of the left 121 and right brackets 123 of each of the first device 102 and the second device 104 has two outwardly positioned parallel plates 84 with a vertically aligned slot 86 therebetween. The method further includes inserting the blocking panel 110 concurrently in both the slot 86 of the right bracket 123 of the first device 102 and the slot 86 of the left bracket 121 of the second device 104 to fill the gap 88 above the fence post 116 between the first device 102 on the first fence panel 106 and the second device 104 on the second adjacent fence panel 108.

The device of the present disclosure offers significant advantages over canine containment products of the prior art. In addition to its superior performance in both containing canines within a fenced area, and simultaneously, preventing unwanted entry of other animals such as coyotes, for example, into the fenced area, the device of the present disclosure is extremely easy to assemble, requiring no tools for assembly. Furthermore, the device can be installed in much less time than the prior art systems, saving the user a significant amount in labor costs.

While the invention has been particularly shown and described with reference to specific embodiments, it should be apparent to those skilled in the art that the foregoing is illustrative only and not limiting, having been presented by way of example only. Various changes in form and detail may be made therein without departing from the spirit and scope of the invention. Therefore, numerous other embodiments are contemplated as falling within the scope of the present invention as defined by the accompanying claims and equivalents thereto.

What is claimed is:

1. A device configured for installation on a fence panel of a fence comprising a plurality of posts with fence panels therebetween for canine containment, the device comprising:

a pair of brackets, each bracket including a mounting portion configured for mounting on an upper end of a fence panel and a support plate extending upward from the mounting portion;

two pins extending perpendicularly from a first side of the support plate of each bracket, the two pins including an upper pin and a lower pin aligned in a vertical plane;

two parallel plates extending vertically outward from a second side of the support plate opposite the first side and forming a slot therebetween;

a blocking panel removably positioned between the second sides of adjacent brackets and engaged within the slots thereof substantially above one of the posts of the fence; and two hollow cylindrical rods positioned between the pair of brackets with the first side of the support plate of each bracket in the pair facing each other, wherein each end of an upper one of the two hollow cylindrical rods is rotatably mounted onto the upper pin of each bracket, and each end of a lower one of the two hollow cylindrical rods is rotatably mounted onto the lower pin of each bracket, wherein the pair of brackets with the two hollow cylindrical rods mounted therebetween form a unit configured to place atop a fence panel intact and fixed thereto.

2. The device of claim 1, further comprising an end cap fixedly positioned over each end of the upper one and the lower one of the two hollow cylindrical rods and having a through-hole positioned in a center of the end cap, and wherein the upper pin and the lower pin of each bracket in the pair of brackets is inserted through the through-hole of the end cap fixedly positioned over each end of the upper one and the lower one of the two hollow cylindrical rods, each of the upper one and the lower one of the two hollow cylindrical rods being rotatably connected to the upper pin and the lower pin, respectively, of each bracket in the pair of brackets via the through-hole in the end cap, wherein a diameter of the through-hole corresponding to each end of the upper one and the lower one of the two hollow cylindrical rods is configured to allow free rotation of the upper one and the lower one of the two hollow cylindrical rods around the upper pin and the lower pin, respectively, of each bracket in the pair of brackets.

3. The device of claim 1, wherein an outer cylindrical surface of each of the upper one and the lower one of the two hollow cylindrical rods is smooth.

4. The device of claim 3, wherein each of the two hollow cylindrical rods is a polyvinyl chloride pipe.

5. The device of claim 4, wherein each of the two hollow cylindrical rods has an outer diameter of about 3½ inches.

6. The device of claim 1, further including a fastening element configured to secure the device in position on the fence panel via the mounting portion of each bracket in the pair, and wherein the mounting portion includes a top surface extending parallel to and beneath the upper and lower pins, a first vertical wall and a second vertical wall extending downward from the top surface, wherein each of the first vertical wall and the second vertical wall include a through-aperture configured to insert the fastening element therethrough.

7. The device of claim 6, wherein a spacing between an outer diameter of the lower one of the two hollow cylindrical rods and the top surface of the mounting portion of each bracket in the pair of brackets is between about ¼ inch and ½ inch.

8. The device of claim 1, wherein each of the two hollow cylindrical rods has an outer diameter of about 3½ inches, wherein each of the upper pin and the lower pin is of a length between about 2½ inches and about 3½ inches, and a diameter of between about ½ inch and about ¾ inch; and wherein a center-to-center distance between the two pins is between about 3¾ inches and about 4 inches.

9. A system for canine containment configured for installation on a fence having a plurality of fence panels and fence posts separating adjacent fence panels, the system comprising:

two devices including a first device and a second device, each of the first device and the second device configured to place atop a first one and a second one of two adjacent fence panels, respectively, intact and fixed thereto;

wherein each of the first device and the second device includes:

a left bracket and a right bracket, each including a mounting portion configured for mounting on an upper end of each of the first one and the second one of the two adjacent fence panels and a support plate extending upward from the mounting portion, the support plate including a first side and a second side opposite the first side;

two pins extending perpendicularly inward from the first side of the support plate of each of the left bracket and the right bracket, the two pins including an upper pin and a lower pin aligned in a vertical plane two parallel plate extending vertically outward from the second side of the support plate and forming a slot therebetween;

a blocking panel removably positioned between the second sides of adjacent brackets and engaged within the slots therefore substantially above one of the posts of the fence; and two hollow cylindrical rods positioned in vertical alignment between the left bracket and the right bracket with the first side of the support plate of the left bracket facing the first side of the support plate of the right bracket, and wherein a left end and a right end of an upper one of the two hollow cylindrical rods is each rotatably mounted onto the upper pin of the left bracket and the right bracket, respectively, and a left end and a right end of a lower one of the two hollow cylindrical rods is each rotatably mounted onto the lower pin of the left bracket and the right bracket, respectively.

10. The system of claim 9, wherein the blocking panel is removably positioned vertically and aligned within the slot of the support plate of the right bracket of the first device and the slot of the support plate of the left bracket of the second device, the blocking panel filling a gap between the right bracket of the first device and the left bracket of the second device in use.

11. The system of claim 10, each of the first device and the second device further comprising a left end cap and a right end cap fixedly positioned over the left end and the right end, respectively, of each of the upper one and the lower one of the two hollow cylindrical rods, wherein each of the left end cap and the right end cap has a through-hole that is centrally-positioned, and wherein the upper pin and the lower pin of each of the left bracket and the right bracket is inserted through the through-hole of the left end cap and the right end cap, respectively, of each of the upper one and the lower one of the two hollow cylindrical rods, each of the upper one and the lower one of the two hollow cylindrical rods being rotatably connected to the upper pin and the lower pin, respectively, of each of the left bracket and the right bracket via the through-hole in the left end cap and the right end cap, wherein a diameter of the through-hole is configured to allow free rotation of the upper one and the lower one of the two hollow cylindrical rods around the upper pin and the lower pin, respectively, of each of the left bracket and the right bracket.

12. The system of claim 11, wherein the blocking panel is configured to extend, in use, from a top surface of the fence post separating the two adjacent fence panels to an upper surface of the upper one of the two hollow cylindrical rods.

13. The system of claim 11, wherein each of the two hollow cylindrical rods has an outer diameter of about 3½ inches, wherein each of the upper pin and the lower pin is of a length between about 2½ inches and about 3½ inches, and a diameter of between about ½ inch and about ¾ inch; and wherein a center-to-center distance between the two pins is between about 3¾ inches and about 4 inches.

14. The system of claim 11, wherein a spacing between an outer diameter of the lower one of the two hollow cylindrical rods and a top surface of the mounting portion of each of the left and the right bracket is between about ¼ inch and ½ inch.

15. The system of claim 11, wherein an outer cylindrical surface of each of the upper one and the lower one of the two hollow cylindrical rods is smooth, and wherein each of the two hollow cylindrical rods is a polyvinyl chloride pipe.

16. The system of claim 10, further including a fastening element configured to secure each of the first device and the second device in position on the two adjacent fence panels via the mounting portion of each of the left bracket and the right bracket of each of the first device and the second device, and wherein the mounting portion includes a top surface extending parallel to and beneath the upper and lower pins, a first vertical wall and a second vertical wall extending downward from the top surface, wherein each of the first vertical wall and the second vertical wall include a through-aperture configured to insert the fastening element therethrough.

* * * * *